US005522475A

United States Patent [19]

Thompson

[11] Patent Number: 5,522,475

[45] Date of Patent: Jun. 4, 1996

[54] METHOD AND APPARATUS FOR EXCHANGING OIL IN A COMPRESSOR

[76] Inventor: John L. Thompson, 19 Overlook Dr., Golf, Ill. 60029

[21] Appl. No.: 322,996

[22] Filed: Oct. 14, 1994

[51] Int. Cl.[6] ..... F16C 3/14

[52] U.S. Cl. ..... 184/1.5; 184/109; 62/468

[58] Field of Search ..... 184/1.5, 6.16, 184/109; 137/206, 209; 62/292, 468, 469, 125

[56] References Cited

U.S. PATENT DOCUMENTS 4,535,802 8/1985 Robertson ..... 62/292

5,357,763 10/1994 Vogel ..... 62/292

5,373,914 12/1994 Maher ..... 184/109

*Primary Examiner*—Thomas E. Denion

*Attorney, Agent, or Firm*—Robert J. Black

[57] ABSTRACT

Apparatus and method of exchanging lubricating oil from the crankcase of a compressor. A unit including a pret-rimmed flexible tube is introduced into the oil fill plug opening. By opening an internal valve, the oil under pressure exits through an opening in the unit, which is connected to a drain hose. After emptying, a hand oil pump is connected to the unit and fresh oil introduced into the compressor crankcase.

11 Claims, 2 Drawing Sheets

1
2
3
4
5
6
7
8
9
10
12
13
14
15
16
17
18
19
21
22

METHOD AND APPARATUS FOR EXCHANGING OIL IN A COMPRESSOR

BACKGROUND OF THE INVENTION

1. Field of the Invention

The present invention relates to compressors, particularly to those utilized in air conditioning and refrigeration systems, and more particularly to an oil exchanger utilized to effectively remove oil from the crankcase of such compressors, and for the introducing of replacement oils.

2. Background Art

Techniques for the removal of oil, or similar lubricating materials, from the crankcase of internal combustion engines have been known for many years. However, because of the particular problems involved in removing the oil from the crankcase of compressors utilized in air conditioning and refrigeration systems, relatively few techniques have been developed for this particular purpose. More than ever before, effective techniques are required for such removal and replacement of oils in air conditioning and refrigeration compressors, inasmuch as the current oils being utilized are highly subject when exposed to the atmosphere, to the absorption of moisture which tends to dilute the oils, reducing their lubricating efficiency. Any system to be totally effective must be a hermetic or relatively closed system, which prevents the oil from being exposed to the atmosphere.

A background art search directed to the subject matter of this application and conducted in the U.S. Patent and Trademark Office disclosed the following U.S. Letters Patents:

| | | |
|---|---|---|
| 2,148,807 | 4,240,523 | 5,044,469 |
| 2,856,026 | 4,570,458 | 5,056 623 |
| 3,128,844 | 4,698,983 | 5,074,380 |
| 3,858,686 | 4,807,674 | 5,184,944 |
| 4,095,672 | 4,973,235 | |

None of the patents discovered disclosed an effective apparatus or method for changing the oil from the crankcase of refrigeration or air conditioning compressors. Many of the patents related to the removal of oil from automobile crankcases. The techniques and apparatus related to automobile crankcase oil removal are not appropriate inasmuch as they are not in pressurized systems, such as are found in the compressors for which the present invention is intended.

The only patents related to the removal of oil from compressors, and/or related methods of doing same, are taught by U.S. Pat. Nos. 4,570,458, 4,698,983 and 5,184,944. Of these, only U.S. Pat. No. 5,184,944 is related to the exchanging of oil for drainage, where the crankcase is refilled. U.S. Pat. No. 5,184,944, which issued to Thomas F. Scarfone on Feb. 9, 1993 is related to a method and apparatus for changing lubricating oil in a specially designed rotary compressor, which includes a vertically extending rotor shaft from the top of the case to the bottom, where in the bottom of the case forms the lubricating oil sump. The rotor shaft has a longitudinally extending opening through the shaft which defines a path from the sump to the upper end of the case. Such devices are not of usual design. The particular apparatus and technique enclosed herein is limited by its application to the specialized rotary type compressor with a hollow drive shaft facilitating communication between the oil sump of the compressor with the upper end of the compressor casing.

SUMMARY OF THE INVENTION

The present invention relates to an apparatus that is easily installed and remains permanently in the system to facilitate removal of maximum amounts of oil from the crankcase of air conditioning and refrigeration compressors and the introduction of new oil into the systems after removal of the old. The design is also such as to eliminate the absorption of moisture into the oils as has been found to be a substantial problem in present lubricants as utilized in compressors of the type described. The unit is intended for installation in the usual crankcase oil fill plug of such compressors. Its basic form consists of a body portion having at the lower end thereof threading to facilitate its placement into the threaded oil fill plug opening in the compressor.

On the lower end attached to the body portion is a long tube of flexible materials, such as Teflon, or similar material, which depending on the particular requirements is normally cut from ½" to 1" or longer than the dimension to the bottom of the crankcase when the body is screwed into the oil fill plug opening. The length is chosen so as to cause the tube to bend and insure the end of the tube to be against the bottom of the crankcase sump area to remove as much oil as possible. Contained within the body is a valve which may be opened to allow the flow of oil from a crankcase up through the tube and out through an opening in the body of the exchanger of the present invention. In one embodiment of the present invention, this opening is blocked by a self-contained valve and it has an external portion that is threaded to receive a hose or similar device which may be connected to a bucket or other container to receive the oil removed from the crankcase.

In one embodiment of the present invention, also included is a Schrader valve of the type similar to the valve used in automobile tires. In this particular embodiment, when a hose is connected it must include an apparatus to effectively depress the plunger of the Schrader valve to allow a flow through the valve out through the hose directly into the waste container. In this embodiment, a Schrader valve is mounted within the housing and upon removal of the cap from around the Schrader valve portion of the exchanger, a pressure gauge may be attached thereto and the valve opened slightly to allow the air to flow so the pressure can then be read directly through the Schrader valve connection.

In another form, an orifice extends from the Schrader valve down through the stem portion and adjacent to the Teflon tube provided which allows the pressure to be read directly without opening the principal valve within the housing.

In yet another embodiment having only a Schrader valve connection, a pressure gauge may be connected initially to determine the pressure within the system, and subsequently removed and replaced with an appropriate removal hose which would then allow oil to flow out through the Schrader valve into a waste disposal container.

The present unit as indicated has a body with removable caps over both the Schrader valve opening and the discharge port. Both caps are threaded onto extrusions from the body. The internal valve stem is supported and retained within an orifice inside the body portion by a washer and packing. Access to the main valve in at least one embodiment is provided by removal of cap portion, which is threaded to the upper portion of the body in at least one of the embodiments of the present invention. The particular embodiment of the present invention utilizing only a Schrader valve as the connection point for a pressure gauge and also for removal and introduction of oil into the crankcase of the compressor, in which it is installed, is intended for small compressor units while the embodiment having separate discharge port and pressure gauge connection points, having both a conventional valve stem and a Schrader valve included, is designed for the valve stem and a Schrader valve included, is designed for the more usual types of compressors as utilized in refrigeration and air conditioning systems.

DETAILED DESCRIPTION OF THE PREFERRED EMBODIMENTS

Figures 1, 2:
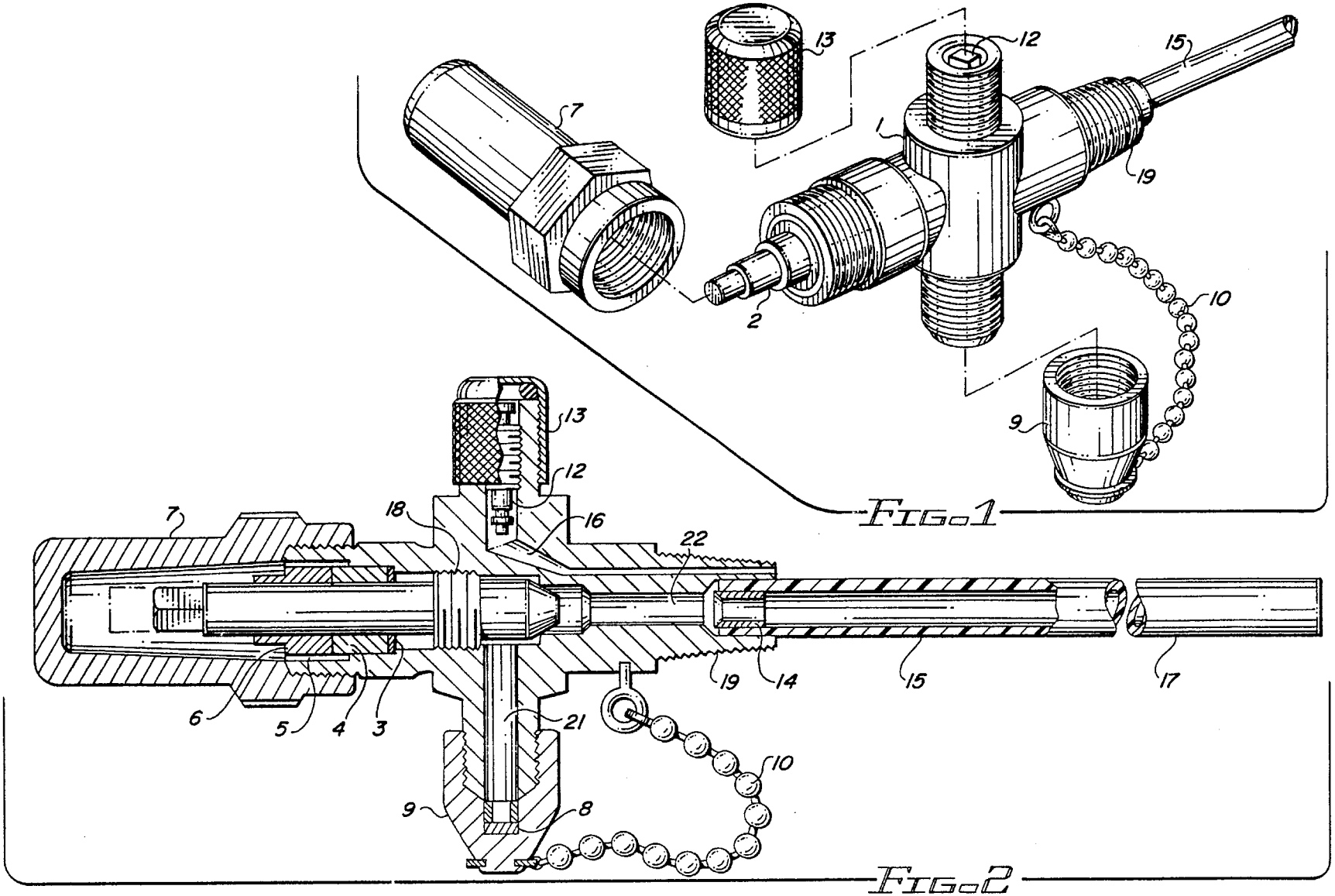
FIG. 1 is a partially exploded isometric view of one embodiment of an oil exchanger for use with air conditioning and refrigeration compressors in accordance with the present invention.
FIG. 2 is a sectional view of the embodiment of an oil exchanger shown in FIG. 1, in accordance with the present invention.

A better understanding of the invention may be had by reference to FIGS. 1 and 2 of the drawings wherein a first embodiment of the present invention is shown.

As may be seen in the drawings, the body portion of the present invention is constructed of forged brass and includes a plurality of passageways within the body. A first passageway seen through the body from left to right as seen in FIG. 2. Included in space at the one end thereof is a threaded valve stem 2 which is maintained within the passageway securely and positioned by means of packing washer 3, packing 4, and a packing gland 5, as well as a gasket 6. This valve stem, constructed of steel, at its upper end includes means for connecting a wrench, or similar tool, so that the valve stems may be rotated, allowing internal passageway 21 to be placed in connection with passageway 22. Packing washer 3 is constructed of steel, with packing 4 made of carboform, while packing gland 5 is constructed of steel and gasket 6 being fashioned of rubber.

In order to secure access to the valve stem 2, it is necessary to remove cap 7, which is threaded to the exterior portion of body 1. Seal cap 7, in at least one embodiment, is constructed of Valox, or similar plastic material. Passageway 21 is normally sealed, except when in operation, by means of gasket 8 and seal cap 9, which is constructed of brass, and is retained to body 1 by means of chain 10, which is secured to body 1 by retainer ring 11. Both the seal cap and chain are constructed of brass, while retainer ring 11 is fashioned of music wire. Within seal cap 9, is a flare gasket 8, which provides a tight seal to the end of passageway 21.

The lower end of body 1 is threaded to facilitate its placement into the threaded oil fill plug opening normally found on compressors. Interior passageway 22 of body 1 is connected to a tubular extension 15, which at its upper end is secured by means of ferrule 14 to the lower end of passageway 22. This extension is constructed of Teflon, or similar material, while the ferrule 14 that secures it within the lower end of body 1 is of brass. In its normal supply function, extension tube 15 is flexible with end 17 extending to the bottom and slightly bent around against the bottom of the internal crankcase portion of the compressor. In practice, this lower end is trimmed so as to cause the tube to bend to ensure the end of the tube to be against the bottom of the crankcase. This cut is usually ½" to 1" longer than to the dimension to the bottom of the crankcase when the body 1 is screwed into the oil fill plug opening.

Also included within the body is a Schrader valve 12, which is threaded into another passageway 16, as shown in FIG. 2 extends to the lower end of the body portion. This passageway 16, however, is separate from passageway 22 and is used to provide the means for connection when seal cap 13, which is constructed of brass, is removed from body 1. At that location a pressure valve may be attached to the Schrader valve, depressing it in a manner similar to that found in automobile tires. It is then utilized to measure the pressure contained within the compressor crankcase.

In an alternate embodiment, passageway 16 extends not to the bottom of body 1, as shown in FIG. 2, but rather may be connected directly into passageway 22 in an area adjacent to the lower end of stem 2. As can be seen then, it would also require that stem 2 be partially withdrawn from its seat in the upper end of passageway 22, allowing a passage from passageway 22 through passageway 16 to the Schrader valve, and any pressure gauge connected thereto.

In initial operation, the compressor, wherein it is desirable to remove and exchange the oil contained therein with new oil, is pumped down to atmospheric pressure in accordance with normal procedures while changing oil. At this time, the crankcase oil fill plug will be carefully removed and the apparatus of the present invention installed as a substitute for the removed oil fill plug. This is accomplished by inserting it and then screwing it tightly in place, using the threads 19, which are intended to properly engage with threads in the compressor crankcase.

Prior to insertion, extension tube 15 will be cut at its lower end 17 so as to be ½" to 1" longer than the dimension to the bottom of the compressor crankcase. Thus, when inserted, the extension tube 15 will bend at its lower end 17 to ensure that end 17 is against the bottom of the crankcase to facilitate the removal of as much oil as possible. At this point in time, a charging hose, or manifold, may be connected to the apparatus by means of removal of seal cap 9 from passageway 21. The opposite end of the hose is placed into an open container, such as a bucket, etc. At this time, the valve stem 2 will be rotated, allowing a connection to become established between extension tube 15, body passageway 22 and body passageway 21, which will cause the oil to be pushed out of the crankcase through the hose or manifold into the open container. It should be noted that prior to removal, the crankcase should have been leak tested and pressurized to five or ten pounds.

To refill the crankcase of the compressor, the hose or manifold that was previously used to drain the oil from the crankcase is then connected to a hand oil pump, or similar device, to force oil trough the hose or manifold and through passageways 21 and 22 and extension tube 15 back into the compressor crankcase. After the crankcase has been filled properly by the above method, the valve 2 will be closed and cap 7 replaced. The hose or manifold is then removed from the part of body 1 that includes passageway 21 and seal cap 9 reinstalled. The exchanging apparatus of the present invention will now be allowed to remain in place in the compressor oil fill plug for future oil changes.

In the case of future oil changes, pressure readings may be taken by removing seal cap 13 and connecting a pressure gauge to passageway 16 to determine the internal pressure within the crankcase. After this measurement has been taken, the pressure gauge is removed from its connection where it had been utilized to depress Schrader valve 12 and seal cap 13 reinstalled to seal that particular portion of the present invention.

Figure 3:
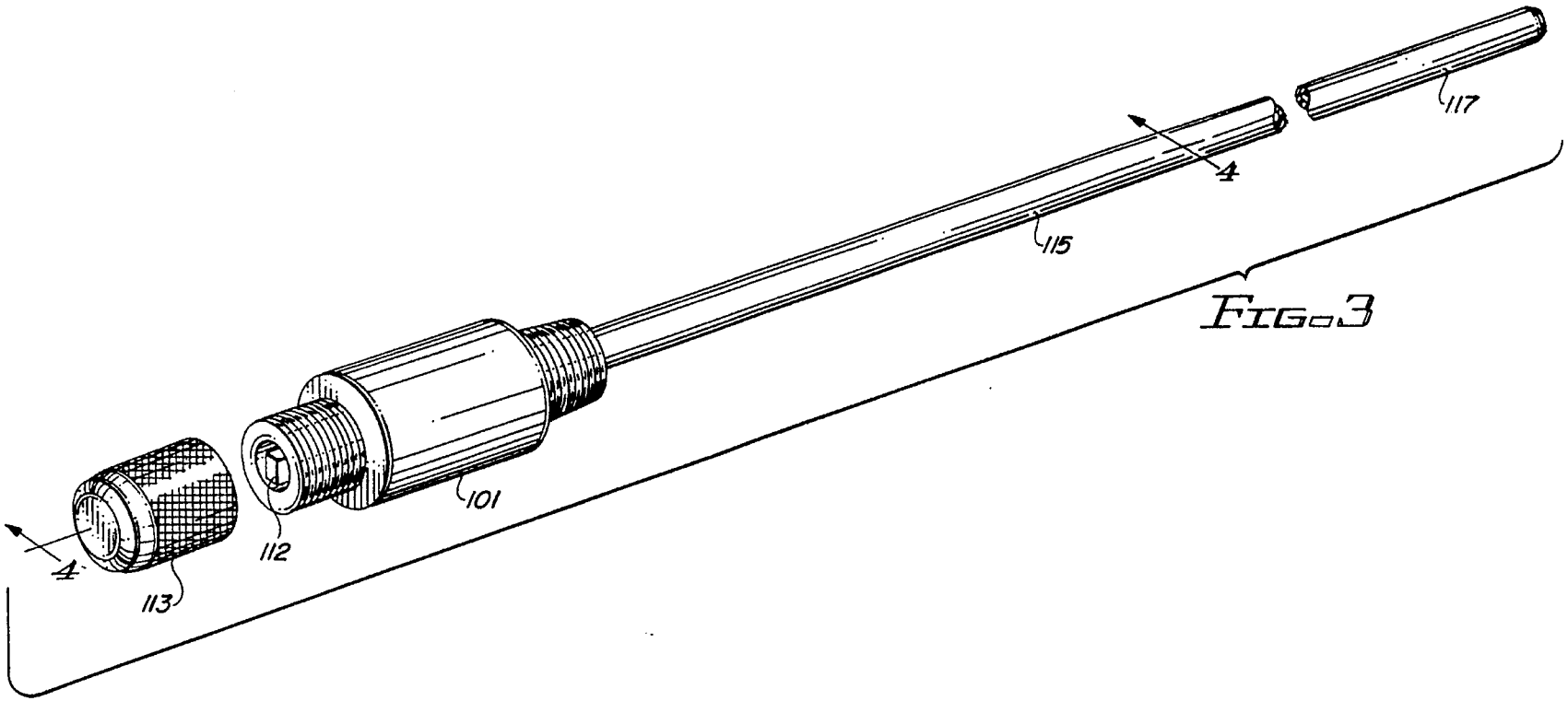
FIG. 3 is a partially exploded isometric view of another embodiment of an oil exchanger in accordance with the present invention.
Figure 4:
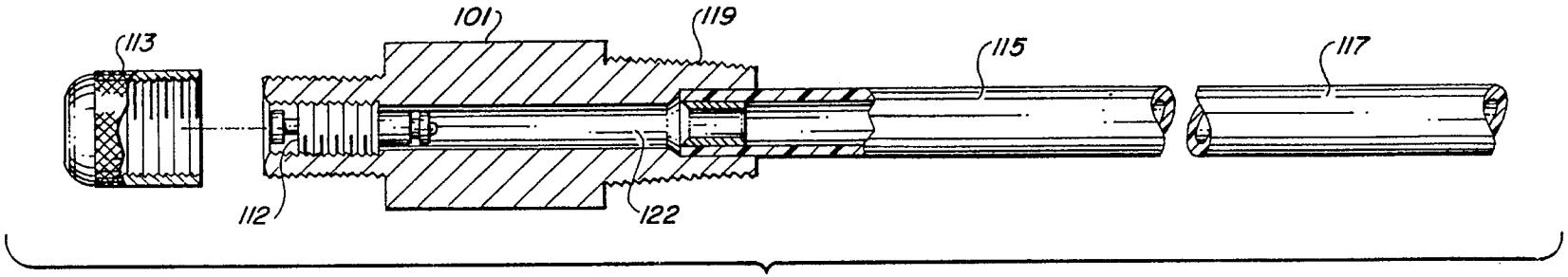
FIG. 4 is a sectional view of the embodiment of an oil exchanger shown in FIG. 3 in accordance with the present invention.

An alternate version of the present invention is shown in FIGS. 3 and 4. This embodiment is intended for use in smaller compressors and consists of a brass body 101 open at its upper and lower ends and having a passageway running through one end of the body to the other. At the one end, threads 119 are provided for insertion of the apparatus into compressor crankcase oil fill plug area. A threaded portion at the upper end of body 101 is adapted to receive a brass seal cap 113. As seen within the upper end of internal passageway 122 is a Schrader type valve 112, which operates as previously described. Connected at the other end is an extension tube 115 constructed of Teflon, or similar material, including a lower end 117. Teflon tube 115 is secured within the lower end of body portion 101 by means of ferrule 114. In actual operation, the apparatus is affixed to the crankcase compressor in place of the oil fill plug in a manner as previously described in other embodiments, and the seal cap 113 removed providing access to Schrader valve 112. At this time, a properly fitted hose or manifold may be connected to the Schrader valve 112 to depress the internal portion to allow the flow of oil to the crankcase through extension tube 115 and out through a hose or manifold connected through the Schrader valve 113 into a bucket or similar waste container.

Before insertion, as with the other described embodiments, the present embodiment has its extension tube 115 trimmed at its lower end 117 so as to be ½" to 1" longer than the dimension to the bottom of the compressor so as to again ensure that the tube rests against the bottom of the compressor crankcase to facilitate the removal of the maximum amount of lubricant contained therein.

Refilling the compressor follows the procedure similar to that previously described where a hand oil pump, or similar device, is connected to the hose or manifold used for the evacuation of the compressor.

While only certain embodiments of the present invention have been shown, it will be obvious to those skilled in the art that numerous modifications may be made without departing from the spirit of the present invention, which shall be limited only by the scope of the claims appended hereto.

What is claimed is:

1. Apparatus for exchanging lubricating oil in a compressor, said apparatus comprising:

a body portion;

threaded means on an external end of said body to secure said apparatus into a crankcase oil fill plug opening included in said compressor;

a first passageway extending longitudinally through said body;

valve means contained within a first end of said passageway;

hollow flexible extension means connected to a second end of said passageway;

said extension means adapted to be trimmed to a predetermined length to facilitate withdrawal of maximum quantities of said lubricating oil from said compressor crankcase;

said body further including a lubricating oil discharge port comprising a second passageway for connecting said first passageway to the exterior of said body in response to operation of said valve means.

2. Apparatus for changing lubricating oil in a compressor as claimed in claim 1 wherein:

there is further included a cover removably secured to said body adjacent to the first end of said first passageway.

3. Apparatus for changing lubricating oil in a compressor as claimed in claim 1 wherein:

there is further included cover means removably secured to the exterior of said body adjacent to said discharge port.

4. Apparatus for changing lubricating oil in a compressor as claimed in claim 1 wherein:

there is further included a pressure gauge connection including a third passageway connected between the exterior of said body and said first passageway.

5. Apparatus for changing lubricating oil in a compressor as claimed in claim 4 wherein:

said third passageway further includes valve means operated in response to connection of an external device to said third passageway to provide an open pathway through said third passageway from said external device to said first passageway.

6. Apparatus for changing lubricating oil in a compressor as claimed in claim 4 wherein:

there is further included cover means removably secured to the exterior of said body adjacent to said third passageway.

7. Apparatus for changing lubricating oil in a compressor as claimed in claim 1 wherein:

said body further includes a passage gauge connection including a third passageway extending from the exterior of said body to a location adjacent to said flexible tube to provide an external passageway from the exterior to said compressor crankcase upon insertion of said apparatus into said crankcase oil fill plug.

8. Apparatus for changing lubricating oil in a compressor as claimed in claim 7 wherein:

said third passageway further includes valve means operated in response to connection of an external device to said third passageway to provide an open pathway through said third passageway from said external device to said first passageway.

9. Apparatus for changing lubricating oil in a compressor as claimed in claim 7 wherein:

there is further included cover means removably secured to the exterior of said body adjacent to said third passageway.

10. A method for changing lubricating oil in a compressor having a crankcase equipped with a crankcase oil fill plug, the method comprising the steps of:

trimming apparatus;equipped with a flexible tube to a length between ¼" and 1¼" longer than the distance between the crankcase oil fill plug opening to the bottom of the crankcase;

connecting a pressure gauge to said apparatus;

measuring the pressure within said crankcase with said pressure gauge;

reducing the pressure contained within the compressor to an atmospheric pressure level;

removing the crankcase oil fill plug;

inserting the apparatus of claim 1 and securing it in the crankcase oil fill plug opening;

connecting an external connection from said apparatus through passageway internal to said tube, to a hollow means connecting said apparatus to a container;

opening a valve included in said apparatus;

allowing said lubricating oil to be drawn from said crank case.

11. A method of changing lubricating oil in a compressor as claimed in claim 10 wherein:

after oil has been evacuated from said crankcase, connecting a hand oil pump to said apparatus;

manually operating said pump to introduce new oil into said crankcase through said flexible tube;

closing said valve included in said apparatus;

and disconnecting said external connection to said hand oil pump from said apparatus.

* * * * *